US006277796B1

(12) United States Patent
Sivik et al.

(10) Patent No.: US 6,277,796 B1
(45) Date of Patent: Aug. 21, 2001

(54) DRYER-ACTIVATED FABRIC CONDITIONING AND ANTISTATIC COMPOSITIONS WITH IMPROVED PERFUME LONGEVITY

(75) Inventors: Mark Robert Sivik, Fairfield; Jill Bonham Costa, Cincinnati; Daniel Dale Ditullio, Jr., Fairfield; John Michael Gardlik; Frederick Anthony Hartman, both of Cincinatti; Janet Sue Littig, Fairfield; Rafael Ortiz, Milford; John Cort Severns, West Chester; Toan Trinh, Maineville, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/331,308

(22) PCT Filed: Dec. 19, 1997

(86) PCT No.: PCT/US97/23606

§ 371 Date: Apr. 19, 2000

§ 102(e) Date: Apr. 19, 2000

(87) PCT Pub. No.: WO98/27190

PCT Pub. Date: Jun. 25, 1998

Related U.S. Application Data

(60) Provisional application No. 60/033,512, filed on Dec. 19, 1996.

(51) Int. Cl.[7] ..... C11D 3/50
(52) U.S. Cl. ..... 510/101; 510/519
(58) Field of Search ..... 510/101, 519

(56) References Cited

U.S. PATENT DOCUMENTS

| | | | | |
|---|---|---|---|---|
| 3,932,520 | | 1/1976 | Hoffmann | 260/594 |
| 5,246,918 | * | 9/1993 | Behan et al. | 512/2 |
| 5,378,468 | | 1/1995 | Suffis et al. | 424/401 |
| 5,425,887 | * | 6/1995 | Lam et al. | 252/8.6 |
| 5,447,644 | * | 9/1995 | Guenin et al. | 252/8.6 |
| 5,500,138 | | 3/1996 | Bacon et al. | 252/8.8 |
| 5,665,698 | | 9/1997 | Narula et al. | 512/19 |

FOREIGN PATENT DOCUMENTS

| | | |
|---|---|---|
| 3603661 | 2/1986 | (DE) . |
| 379981 | 1/1990 | (EP) . |
| 738700 | 10/1996 | (EP) . |
| WO 94/27946 | 12/1994 | (WO) . |
| WO 97/34578 | 9/1997 | (WO) . |

OTHER PUBLICATIONS

Abstract XP002062565 Nos. 153, 662, 1697, 1702, 1729, 2473, 2476, 2478, 2480: Steffen Arctander, "Perfume and Flavor Chemicals", Arctander's Publications (1969).

* cited by examiner

*Primary Examiner*—John Hardee
(74) *Attorney, Agent, or Firm*—Richard S. Echler, Sr.; Kim William Zerby; Steven W. Miller

(57) ABSTRACT

The present invention relates to dryer-activated fabric softening compositions comprising: (A) pro-perfume acetal compounds; (B) fabric softening compounds; and (C) optionally, (1) a carboxylic acid salt of a tertiary amine and/or a tertiary amine ester; and (2) a nonionic softener; wherein, preferably, the Iodine Value of the total number of fatty acyl groups present in (A), (C)(1), and (C)(2) is from about 3 to about 60. These compositions exhibit good antistatic properties as well as improved delivery from a substrate.

21 Claims, No Drawings

DRYER-ACTIVATED FABRIC CONDITIONING AND ANTISTATIC COMPOSITIONS WITH IMPROVED PERFUME LONGEVITY

This Appln is a 371 of PCT/US97/23606 filed Dec. 19, 1997 which claims the benefit of Prov. No. 60/033,512 filed Dec. 19,1996.

TECHNICAL FIELD

The present invention relates to an improvement in dryer activated, e.g., dryer-added, softening products, compositions, and/or the process of making these compositions containing acetal pro-fragrance compounds and methods for accomplishing the delivery of such organic pro-fragrance compounds to textile articles and other surfaces dried with said compositions. These products and/or compositions are either in particulate form, compounded with other materials in solid form, e.g., tablets, pellets, agglomerates, etc., or preferably attached to a substrate. The fragrance is released in fragrance-active form when the dried surface is subsequently contacted with a lower pH environment such as contact with water, carbon dioxide gas, humid air, or the like.

BACKGROUND OF THE INVENTION

Consumer acceptance of laundry products is determined not only by the performance achieved with these products but the aesthetics associated therewith. The perfume systems are therefore an important aspect of the successful formulation of such commercial products.

What perfume system to use for a given product is a matter of careful consideration by skilled perfumers. While a wide array of chemicals and ingredients are available to perfumers, considerations such as availability, cost, and compatibility with other components in the compositions limit the practical options. Thus, there continues to be a need for efficient, low-cost, compatible perfume materials useful for laundry compositions.

Furthermore, due to the high energy input and large air flow in the drying process used in the typical automatic laundry dryers, a large part of most perfumes provided by fabric softener products is lost from the dryer vent. Perfume can be lost even when the fabrics are line dried. The amount of perfume carry-over from a laundry process onto fabrics is often marginal and does not last long on the fabric. Fragrance materials are often very costly and inefficient use in rinse added and dryer added fabric softener compositions very costly and inefficient use in rinse added and dryer added fabric softener compositions and ineffective delivery to fabrics results in a very high cost to both consumers and fabric softener manufacturers. Industry, therefore, continues to look for more efficient and effective fragrance delivery in fabric softener products, especially for improvement in the provision of long-lasting fragrance to the dried fabrics.

It has now been discovered that pro-perfume acetals provide efficient and effective fragrance delivery when incorporated into a dryer added fabric softener matrix. It has also been discovered that fabric softener compositions containing these acetals can effectively be incorporated into articles of manufacture that provide an effective and efficient means for consumers to obtain a prolonged positive scent signal on laundered textiles.

BACKGROUND ART

Acetals have long been known in perfumery. See Steffen Arctander, "Perfume and Flavor Chemicals", Arctander, N.J., 1969. The majority of these are methyl and ethyl types, and molecular weights may range widely. See, for example, Arctander abstract numbers 6, 11, 210, 651, 689, 1697, 1702, 2480, 2478. For 2478, which is phenylacetaldehyde dicitronellyl acetal, molecular weight 414.7, Arctander reports ". . . and it is not exaggerated to say that this acetal is practically abandoned and obsolete in today's perfumery". For 2480, which is phenylacetaldehyde digeranyl acetal, Arctander reports "the title material does not offer substantial advantages or unique odor type and it may be considered of little more than academic interest today". This latter material was still commercially available in 1992 as ROSETAL A (Catalogue, IFF). Acetals are also frequently used in chemical synthesis as protecting groups for alcohols and aldehydes in basic pH systems. See, for example, March, Advanced Organic Chemistry, 3rd Ed., pp. 329–332 (Wiley, N.Y., 1985). When used as a protecting group, subsequent treatment of an acetal under acidic conditions liberates the parent alcohol and aldehyde.

Carrier mechanisms for perfume delivery, such as by encapsulation, have been taught in the prior art. See for example, U.S. Pat. No. 5,188,753.

U.S. Pat. No. 5,378,468, Suffis et al, issued Jan. 3, 1995 describes specific types of personal care compositions, such as deodorant sticks, comprising assertedly "body-activated" fragrances. The term apparently refers to the previously known tendency of materials such as acetals derived from fragrance alcohols to hydrolyze under acidic pH conditions thereby releasing fragrance. See, for example, U.S. Pat. No. 3,932,520, Hoffman, issued Jan. 13, 1976.

Factors affecting substantivity of fragrance materials on fabrics are discussed in Estcher et al. JAOCS 71 p. 31–40 (1994).

SUMMARY OF THE INVENTION

The present invention relates to dryer-activated fabric softening compositions and articles having improved biodegradability, softness, perfume delivery from sheet substrates (lower m.p. range), and/or antistatic effects, for use in an automatic clothes dryer. These compositions and/or articles comprise, as essential ingredients:

(A) from about 0.01% to about 15%, by weight of the composition, preferably from about 0.1% to about 10%, more preferably from about 0.25% to about 5%, of pro-fragrant acetal, said acetal having the formula:

I.

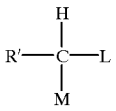

wherein R' and the H are derived from parent aldehyde having a chain length of $C_8$ or greater and wherein L and M are alkoxy moieties derived from parent alcohols having a chain length Of $C_6$ or greater, and wherein at least one of the parent aldehyde, or alcohols of said pro-fragrant acetal is a fragrance compound;

(B) from about 10% to about 99.99%, preferably from about 15% to about 90%, more preferably from about 30% to about 85%, and even more preferably from about 30% to about 55%, of fabric softening compound, preferably quaternary ammonium compound, more preferably biodegradable, and even more preferably, selected from the group consisting of the compounds of Formulas I, II, III, IV, and mixtures thereof, as described hereinafter; and wherein these compositions optionally contain ingredients, as described hereinafter, selected from the group consisting of:

(C) (1) co-softeners which are a carboxylic acid salt of a tertiary amine and/or ester amine;
(2) nonionic softeners;
(3) soil release agents;
(4) cyclodextrin/perfume complexes and free perfume;
(5) stabilizers; and
(6) other minor ingredients conventionally used in textile treatment compositions.

The active fabric softening components preferably contain unsaturation to provide improved antistatic benefits. The Iodine Value of the composition is preferably from about 3 to about 60, more preferably from about 8 to about 50, and even more preferably from about 12 to about 40. The Iodine Value of the composition represents the Iodine Value of the total fatty acyl groups present in components (B), (C)(1), and (C)(2) described below. The unsaturation may be present in one or more of the active components of (B), (C)(1), and/or (C)(2).

DETAILED DESCRIPTION OF THE INVENTION

The compositions of the present invention comprise two essential elements, pro-fragrant acetal ingredients, and ingredients useful for formulating dryer added fabric softening compositions. The invention can also contain conventional ingredients found in dryer added fabric softener compositions.

A. Pro-fragrant Acetal Ingredients

Acetals suitable in the present invention have the following structure:

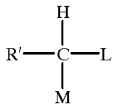

I.

Such acetals can be used to deliver fragrance aldehydes, fragrance alcohols, or both. R' and the H are derived from a starting aldehyde. The parent aldehyde is a fragrant aldehyde when no alcohol parent is fragrant, or can be a fragrant or non-fragrant aldehyde when a fragrant alcohol has been incorporated into the acetal structure. Preferred acetals include those in which R' comprises a $C_8$ or larger alkyl, alkenyl, or aryl moiety. In addition, the non-fragrant aldehyde can contain one or more aldehyde functional groups for derivatization, in which case the acetal can be either monomeric or polymeric. Although polymeric structures are operable, preferred acetals herein are mono-acetals and di-acetals, most preferably monoacetals. The present compositions can optionally include hemiacetals, but hemiacetals are by definition not acetals herein and can not be used as the essential pro-fragrant component.

In general, both fragrant and non-fragrant aldehydes incorporated into the instant acetals can be aliphatic, allylic or benzylic. The aldehydes can be saturated, unsaturated, linear, branched, or cyclic. The structures can include alkyl, alkenyl, or aryl moieties, as well as additional functional groups such as alcohols, amines, amides, esters, or ethers.

L and M in the above general structure represent independently variable alkoxy moieties derived from alcohols that can be either fragrant alcohols or non-fragrant alcohols, provided that when no fragrant aldehyde is incorporated into the acetal, at least one fragrant alcohol is incorporated. L and M can be the same or different allowing the delivery of more than one type of fragrant alcohol. When the alcohols are non-fragrant alcohols, it is preferred that they are $C_{6-C20}$ alcohols, especially fatty alcohols, which may optionally be modified by ethoxylation, propoxylation or butoxylation. L and M can be simple alcohols containing a single OH group, or can be polyols containing 2 or more OH groups, more preferably, diols.

The acetals herein, when formed using polyols, can be cyclic or acyclic acetals derivatizing one or more aldehydes. In general, alcohols can be saturated, unsaturated, linear or branched, alkyl, alkenyl, alkylaryl, alkylalkoxylate derivatives with one or more alcohol groups. The alcohols may contain additional functionality such as amines, amides, ethers, or esters as a part of their structure.

Alternately, though less desirably, other hydrophobic non-fragrant alcohols may be substituted for the above-identified alcohols while remaining within the spirit and scope of the invention.

More generally, a wide range of acetals are included within the invention. As noted above, the acetals are derived from an aldehyde and an alcohol, at least one of which is a fragrance compound. Many fragrant aldehydes, and alcohols which are suitable parent compounds for the present acetals are known to the art. See, for example, Arctander's compilation referenced hereinabove for fragrant parent compounds. Specific fragrant parent aldehydes include but are not limited by the following examples: adoxal; chrysanthal; cyclamal; cymal; trans-4-decanal; ethyl vanillin; helional; hydrotrope aldehyde; hydroxycitronellal; isocyclocitral; melonal; methyl nonyl aldehyde; methyl octyl aldehyde; octyl aldehyde; phenyl propanal; citronellal; dodecyl aldehyde; hexylcinnamic aldehyde; myrac aldehyde; vanillin; anisic aldehyde; citral; decyl aldehyde; floralozone; p.t.-bucinal; and triplal. Preferably, the fragrant parent aldehyde is selected from the group consisting of: citronellal; dodecyl aldehyde; hexylcinnamic aldehyde; myrac aldehyde; vanillin; anisic aldehyde; citral; decyl aldehyde; floralozone; p.t.-bucinal; and triplal. Most preferably, the fragrant parent aldehyde is selected from the group consisting of: anisic aldehyde; citral; decyl aldehyde; floralozone; p.t.-bucinal; and triplal Alternately, the aldehyde can be non-fragrant. Nonfragrant aldehydes include 1,4-terephthalyl dicarboxaldehyde or other aldehydes having low volatility by virtue of incorporation of bulky polar moieties.

Preferably at least one parent alcohol of the pro-fragrant compound is selected from the group consisting of fragrant $C_6$ to $C_{20}$ saturated or unsaturated, linear, cyclic or branched, substituted or unsubstituted alcohols, and alkoxylates of said alcohols. Specific parent alcohols of fragrant types suitable herein are likewise given in Arctander and preferably include but are not limited by amyl alcohol; undecylenic alcohol; osyrol; sandalore; dihydro carveol; dihydro linalool; dihydromyrcenol; dihydro terpineol; dimetol: mycenol; alpha-terpineol; tetrahydro linalool; tetrahydro mugol; tetrahydro myrcenol; amyl cinnamic alcohol; decenol; trans-2-hexenol; patchomint; prenol; cuminyl alcohol; para-tolyl alcohol; phenylethyl carbinol; ethyl vanillin; isoamyl salicylate; para-hydroxyphenyl butanone; phenethyl salicylate; ethyl linalool; linalool; dihydromyrcenol; nerolidol; beta gamma hexenol; decyl alcohol; dihydro floralol; hawthanol; heptyl alcohol; isoamyl alcohol; isocyclo geraniol; isononyl geraniol; mayol; methyl lavendar ketone; octyl alcohol;

phenyl propyl alcohol; rhodinol 70; rosalva; camelkol dh; cyclohexyl propyl alcohol; isobutyl benzyl alcohol; lavinol; phenyl ethyl methyl carbinol; propyl benzyl carbinol; iso pulegol; menthol; patchone; rootanol; roselea; trans decahydro beta naphthol; verdol; cinnamic alcohol; famesol; geraniol; nerol; anisic alcohol; benzyl alcohol; undecavertol; eugenol; isoeugenol; and vanillin. Most preferably, the fragrant parent alcohol is selected from the group consisting of: beta gamma hexenol; decyl alcohol; dihydro floralol; hawthanol; heptyl alcohol; isoamyl alcohol; isocyclo geraniol; isononyl geraniol; mayol; methyl lavendar ketone; octyl alcohol; phenyl propyl alcohol; rhodinol 70; rosalva; camelkol dh; cyclohexyl propyl alcohol; isobutyl benzyl alcohol; lavinol; phenyl ethyl methyl carbinol; propyl benzyl carbinol; iso pulegol; menthol; patchone; rootanol; roselea; trans decahydro beta naphthol; verdol; cinnamic alcohol; farnesol; geraniol; nerol; anisic alcohol; benzyl alcohol; undecavertol; eugenol; isoeugenol; and vanillin.

Other parent alcohols which can be used include lauryl alcohol, myristyl alcohol, and 2-ethylhexanol; parent alcohols having very low odor or alcohols which are essentially non-fragrant, include stearyl and behenyl alcohols.

Many other suitable parent alcohols, aldehydes and ketones are obtainable commercially from perfume houses such as IFF, Firmenich, Takasago, H&R, Givaudan-Roure, Dragoco, Aldrich, Quest, and others.

Specific preferred pro-fragrant acetal compounds are non-limitingly illustrated by the following: digeranyl citral acetal; di(dodecyl) citral acetal; digeranyl vanillin acetal; didecyl hexyl cinnamaldehyde acetal; didecyl ethyl citral acetal; di(dodecyl) ethyl citral; didecyl anisaldehyde acetal; di(phenylethyl) ethyl vanillin acetal; digeranyl p-t-bucinal acetal; didecyl triplal acetal; di(dodecyl) triplal acetal; digeranyl decanal acetal; di(dodecyl) decanal acetal; dicitronellyl laural acetal; di(tetradecyl) laural acetal; di(octadecyl) helional acetal; di(phenylethyl) citronellal acetal; di(3-methyl-5-phenyl pentanol) citronellal acetal; di(phenylhexyl) isocitral acetal; di(phenylethyl) floralozone acetal; didodecyl floralozone acetal; di(2-ethylhexyl) octanal acetal; di (9-decen-1-yl) p-t-bucinal acetal; di(cis-3-hexenyl) methyl nonyl acetaldehyde acetal and di(phenylethyl) p-t bucinal acetal.

It is also within the scope of the present invention for a blend of 2 or more parent alcohols to be reacted with a specific parent aldehyde resulting in pro-fragrant acetals having a varied distribution of alkoxy substituents. Such distributed acetals can provide a "bouquet" of scent signals from a single parent molecule. Similarly, it is also within the scope of the present invention for a mixture of aldehydes to be reacted with a specific alcohol resulting in mixture of aldehyde acetals.

A pro-fragrance can be used as the sole fragrance component of the present fabric softening compositions, or in combination with other pro-fragrances and/or in combination with other fragrance materials, extenders, fixatives, diluents and the like. In general where pro-fragrances are used along with other fragrance materials in fabric softening compositions herein it is preferred that the pro-fragrance be added separately from the other fragrance materials.

Synthesis of pro-fragrances

Acetals and ketals can be prepared by the acid catalyzed reaction of an aldehyde or ketone with an alcohol (or diol), using conventional acid catalysis such as HCl or p-toluenesulfonic acid, or supported sulfonic acid catalysts e.g., AMBERLYST 15™. See Meskens, F., *Synthesis,* (7) 501 (1981) and Meskens, F., *Jannsen Chim Acta* (1) 10 (1983). Many aldehyde, ketone and alcohols useful in the synthesis of acetal and ketal pro-fragrances of the present invention are sensitive to strong acid conditions and can undergo undesirable side reactions. See Bunton, C. A. et al, *J. Org. Chem.* (44), 3238, (1978), and Cort, O., et al, *J. Org. Chem.* (51), 1310 (1986). It is also known that acetals of alpha, beta unsaturated aldehydes can undergo migration of the double bond under the inappropriate selection of the acid catalyst. See Meskens, *F., Synthesis,* (7), 501, (1981) and Lu, T.-J, et al. *J. Org. Chem.* (60), 2931, (1995), Miyashita, M., et al. *J. Org. Chem.* (44) , 3772 (1977). For acid sensitive materials, acid catalysts with pKa's between 3 and 4 are the most desirable to minimize double bond migration while maintaining the reactivity necessary to produce the acetal (or ketal). For example, in the synthesis of digeranyl decanal, p-toluenesulfonic acid ($pK_a$=1) causes undesirable side reactions with geraniol. Citric acid ($pK_{a1}$=3.1, $pK_{a2}$=4.8, $pK_{a3}$=6.4) or pyridinium p-toluenesulfonate can be used to form the acetal without side reactions.

Another technique of avoiding side reactions in preparing acetals of acid sensitive materials, such as geraniol, is by transacetalization of a dimethyl acetal with a higher molecular weight alcohol, using a mild Lewis acid such as titanium.

When prepared according to the before mentioned synthetic routes, the acetals of the present invention may also contain minor levels of the corresponding vinyl ether.

B. Fabric Softening Compound

Compositions of the present invention contain from about 10% to about 99.99%, preferably from about 15% to about 90%, more preferably from about 30% to about 85%, and even more preferably from about 30% to about 55%, of fabric softening compound, preferably ester quaternary ammonium compound (EQA).

Preferably, the EQA of the present invention is selected from Formulas I, II, III, IV, and mixtures thereof.

Formula I comprises:

$$(R^1)_{4-p}—N^+—((CH_2)_v—Y—R^2)_pX^-$$

wherein each Y=—O—(O)C—, or —C(O)—O—;

p=1 to 3;

each v=is an integer from 1 to 4, and mixtures thereof;

each $R^1$ substituent is a short chain $C_1$–$C_6$, preferably $C_1$–$C_3$, alkyl group, e.g., methyl (most preferred), ethyl, propyl, and the like, benzyl and mixtures thereof;

each $R^2$ is a long chain, saturated and/or unsaturated (IV of from about 3 to about 60), $C_8$–$C_{30}$ hydrocarbyl, or substituted hydrocarbyl substituent and mixtures thereof; and the counterion, $X^-$, can be any softener-compatible anion, for example, methylsulfate, ethylsulfate, chloride, bromide, formate, sulfate, lactate, nitrate, benzoate, and the like, preferably methylsulfate.

It will be understood that substituents $R^1$ and $R^2$ of Formula I can optionally be substituted with various groups such as alkoxyl or hydroxyl groups. The preferred compounds can be considered to be diester (DEQA) variations of ditallow dimethyl ammonium methyl sulfate (DTDMAMS), which is a widely used fabric softener. At least 80% of the DEQA is in the diester form, and from 0% to about 20%, preferably less than about 10%, more preferably less than about 5%, can be EQA monoester (e.g., only one —Y—$R^2$ group).

As used herein, when the diester is specified, it will include the monoester that is normally present. For the optimal antistatic benefit the percentage of monoester should be as low as possible, preferably less than about 2.5%. The level of monoester present can be controlled in the manufacturing of the EQA.

EQA compounds prepared with fully saturated acyl groups are rapidly biodegradable and excellent softeners. However, it has now been discovered that compounds prepared with at least partially unsaturated acyl groups have advantages (i.e., antistatic benefits) and are highly acceptable for consumer products when certain conditions are met.

Variables that must be adjusted to obtain the benefits of using unsaturated acyl groups include the Iodine Value of the fatty acids, the odor of fatty acid starting material, and/or the EQA. Any reference to Iodine Value values hereinafter refers to Iodine Value of fatty acyl groups and not to the resulting EQA compound.

Antistatic effects are especially important where the fabrics are dried in a tumble dryer, and/or where synthetic materials which generate static are used. As the Iodine Value is raised, there is a potential for odor problems.

Some highly desirable, readily available sources of fatty acids such as tallow, possess odors that remain with the compound EQA despite the chemical and mechanical processing steps which convert the raw tallow to finished EQA. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior performance which has not been recognized.

Generally, hydrogenation of fatty acids to reduce polyunsaturation and to lower Iodine Value to insure good color and odor stability leads to a high degree of trans configuration in the molecule. Therefore, diester compounds derived from fatty acyl groups having low Iodine Value values can be made by mixing fully hydrogenated fatty acid with touch hydrogenated fatty acid at a ratio which provides an Iodine Value of from about 3 to about 60. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc.

It has been found that a solvent may be used to facilitate processing of the Formula I EQA and/or of the fabric softening composition containing the Formula I EQA. Possible solvents include $C_1$–$C_{30}$ alcohols, with secondary and tertiary alcohols preferred, e.g., isopropanol, and $C_8$–$C_{30}$ fatty acids.

It has also been found that for good chemical stability of the diester quaternary compound in molten storage, water levels in the raw material must be minimized to preferably less than about 1% and more preferably less than about 0.5%. Storage temperatures should be kept as low as possible and still maintain a fluid material, ideally in the range of from about 45° C. to about 70° C. The optimum storage temperature for stability and fluidity depends on the specific Iodine Value of the fatty acid used to make the diester quaternary and the level/type of solvent selected. Also, exposure to oxygen should be minimized to keep the unsaturated groups from oxidizing. It can therefore be important to store the material under a reduced oxygen atmosphere such as a nitrogen blanket. It is important to provide good molten storage stability to provide a commercially feasible raw material that will not degrade noticeably in the normal transportation/storage/handling of the material in manufacturing operations.

The following are non-limiting examples of EQA Formula I (wherein all long-chain alkyl substituents are straight-chain):

Saturated $(C_2H_5)_2\ ^+N(CH_2CH_2OC(O)C_{17}H_{35})_2\ (CH_3SO_4)^-$ $(HO\text{-}CH(CH_3)CH_2)(CH_3)^+N(CH_2CH_2OC(O)C_{15}H_{31})_2\ Br^-$ $(CH_3)(C_2H_5)^+N(CH_2CH_2OC(O)C_{13}H_{27})_2\ (HCOO)^-$ $(C_3H_7)(C_2H_5)^+N(CH_2CH_2OC(O)C_{11}H_{23})_2\ (CH_3SO_4)^-$

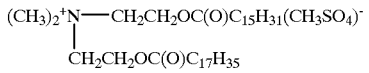

$(CH_3)_2{}^+N(CH_2CH_2OC(O)R^2)_2\ (CH_3SO_4)^-$ where $-C(O)R^2$ is derived from saturated tallow.

Unsaturated $(CH_3)_2{}^+N(CH_2CH_2OC(O)C_{17}H_{33})_2\ (CH_3SO_4)^-$ $(HO\text{-}CH(CH_3)CH_2)(CH_3)^+N(CH_2CH_2OC(O)C_{15}H_{29})_2\ (HCOO)^-$ $(C_2H_5)_2{}^+N(CH_2CH_2OC(O)C_{17}H_{33})_2\ Cl^-$ $(CH_3)(C_2H_5)^+N(CH_2CH_2OC(O)C_{13}H_{25})_2\ (C_6H_5COO)^-$ $(CH_2CH_2OH)(CH_3)^+N(CH_2CH_2OC(O)R^2)_2\ (CH_3SO_4)^-$ $(CH_3)_2{}^+N(CH_2CH_2OC(O)R^2)_2\ (CH_3SO_4)^-$ where $-C(O)R^2$ is derived from partially hydrogenated tallow or modified tallow having the characteristics set forth herein.

In addition to Formula I compounds, the compositions and articles of the present invention comprise EQA compounds of Formula II:

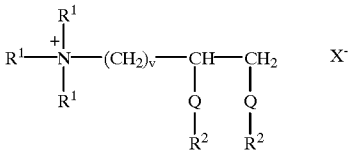

wherein, for any molecule:

each Q is

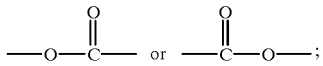

each $R^1$ is $C_1$–$C_4$ alkyl or hydroxy alkyl;

$R^2$ and v are defined hereinbefore for Formula I; and wherein preferably $R^1$ is a methyl group, v is 1, Q is

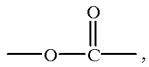

each $R^2$ is $C_{14}$–$C_{18}$, and $X^-$ is methyl sulfate.

The straight or branched alkyl or alkenyl chains, $R^2$, have from about 8 to about 30 carbon atoms, preferably from about 14 to about 18 carbon atoms, more preferably straight chains having from about 14 to about 18 carbon atoms.

Tallow is a convenient and inexpensive source of long chain alkyl and alkenyl materials.

A specific example of a biodegradable Formula II EQA compound suitable for use in the fabric softening compositions herein is: 1,2-bis(tallowyl oxy)-3-trimethyl ammoniopropane methylsulfate (DTTMAPMS).

Other examples of suitable Formula II EQA compounds of this invention are obtained by, e.g., replacing "tallowyl" in the above compounds with, for example, cocoyl, lauryl, oleyl, stearyl, palmityl, or the like;

replacing "methyl" in the above compounds with ethyl, propyl, isopropyl, butyl, isobutyl, t-butyl, or the hydroxy substituted analogs of these radicals;

replacing "methylsulfate" in the above compounds with chloride, ethylsulfate, bromide, formate, sulfate, lactate, nitrate, and the like, but methylsulfate is preferred.

In addition to Formula I and Formula II compounds, the compositions and articles of the present invention comprise EQA compounds of Formula III:

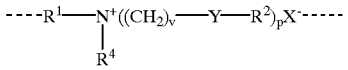

wherein $R^4$=a short chain $C_1$–$C_4$ alcohol;

p is 2;

$R^1$, $R^2$, v, Y, and X- are as previously defined for Formula I.

A specific example of a biodegradable Formula III compound suitable for use in the fabric softening compositions herein is N-methyl-N,N-di-(2-($C_{14}$–$C_{18}$-acyloxy) ethyl), N-2-hydroxyethyl ammonium methylsulfate. A preferred compound is N-methyl, N,N-di-(2-oleyloxyethyl) N-2-hydroxyethyl ammonium methylsulfate.

Compositions of the present invention may also comprise Formula IV compounds:

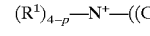

$R^1$, $R^2$, p, v, and X are previously defined in Formula I; and

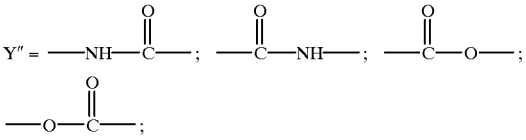

and mixtures thereof, wherein at least one Y" group is

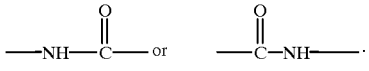

—NH—C— or —C—NH—. An example of this compound is methyl bis (oleyl amidoethyl) 2-hydroxyethyl ammonium methyl sulfate.

Preferably, Component (A) of the present invention is a biodegradable quaternary ammonium compound.

The compounds herein can be prepared by standard esterification and quaternization reactions, using readily available starting materials. General methods for preparation are disclosed in U.S. Pat. No. 4,137,180, incorporated herein by reference.

C. Optional Ingredients

Well known optional components included in fabric conditioning compositions are narrated in U.S. Pat. No. 4,103,047, Zaki et al., issued Jul. 25, 1978, for "Fabric Treatment Compositions," incorporated herein by reference.

(1) Co-Softener

Fabric softening compositions employed herein contain as an optional component, at a level of from about 0% to about 95%, preferably from about 20% to about 75%, more preferably from about 20% to about 60%, a carboxylic acid salt of a tertiary amine and/or ester amine which has the formula:

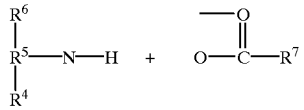

wherein $R^5$ is a long chain aliphatic group containing from about 8 to about 30 carbon atoms; $R^6$ and $R^4$ are the same or different from each other and are selected from the group consisting of aliphatic groups containing containing from about 1 to about 30 carbon atoms, hydroxyalkyl groups of the Formula $R^8OH$ wherein $R^8$ is an alkylene group of from about 2 to about 30 carbon atoms, and alkyl ether groups of the formula $R^9O(C_nH_{2n}O)_m$ wherein $R^9$ is alkyl and alkenyl of from about 1 to about 30 carbon atoms and hydrogen, v is 2 or 3, and m is from about 1 to about 30; wherein $R^4$, $R^5$, $R^6$, $R^8$, and $R^9$ chains can be ester interrupted groups; and wherein $R^7$ is selected from the group consisting of unsubstituted alkyl, alkenyl, aryl, alkaryl and aralkyl of about 8 to about 30 carbon atoms, and substituted alkyl, alkenyl, aryl, alkaryl, and aralkyl of from about 1 to about 30 carbon atoms wherein the substituents are selected from the group consisting of halogen, carboxyl, and hydroxyl, said composition having a thermal softening point of from about 35° C. to about 100° C.

This essential component provides the following benefits: superior odor, and/or improved fabric softening performance, compared to similar articles which utilize primary amine or ammonium compounds as the sole fabric conditioning agent. Either $R^4$, $R^5$, $R^6$, $R^7$, $R^8$, and/or $R^9$ chains can contain unsaturation.

Additionally, tertiary amine salts of carboxylic acids have superior chemical stability, compared to primary and secondary amine carboxylate salts. For example, primary and secondary amine carboxylates tend to form amides when heated, e.g., during processing or use in the dryer. Also, they absorb carbon dioxide, thereby forming high melting carbamates which build up as an undesirable residue on treated fabrics.

Preferably, $R^5$ is an aliphatic chain containing from about 12 to about 30 carbon atoms, $R^6$ is an aliphatic chain of from about 1 to about 30 carbon atoms, and $R^4$ is an aliphatic chain of from about 1 to about 30 carbon atoms. Particularly preferred tertiary amines for static control performance are those containing unsaturation; e.g., oleyldimethylamine and/or soft tallowdimethylamine.

Examples of preferred tertiary amines as starting material for the reaction between the amine and carboxylic acid to form the tertiary amine salts are: lauryldimethylamine, myristyldimethylamine, stearyldimethylamine, tallowdimethylamine, coconutdimethylamine, dilaurylmethylamine, distearylmethylamine, ditallowmethylamine, oleyldimethylamine, dioleylmethylamine, lauryldi(3-hydroxypropyl)amine, stearyldi(2-hydroxyethyl)amine, trilaurylamine, laurylethylmethylamine, and

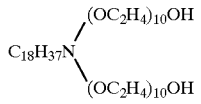

Preferred fatty acids are those wherein $R^7$ is a long chain, unsubstituted alkyl or alkenyl group of from about 8 to about 30 carbon atoms, more preferably from about 11 to about 17 carbon atoms.

Examples of specific carboxylic acids as a starting material are: formic acid, acetic acid, lauric acid, myristic acid, palmitic acid, stearic acid, oleic acid, oxalic acid, adipic acid, 12-hydroxy stearic acid, benzoic acid, 4-hydroxy benzoic acid, 3-chloro benzoic acid, 4-nitro benzoic acid, 4-ethyl benzoic acid, 4-(2-chloroethyl)benzoic acid, phenylacetic acid, (4-chlorophenyl)acetic acid, (4-hydroxyphenyl) acetic acid, and phthalic acid.

Preferred carboxylic acids are stearic, oleic, lauric, myristic, palmitic, and mixtures thereof.

The amine salt can be formed by a simple addition reaction, well known in the art, disclosed in U.S. Pat. No. 4,237,155, Kardouche, issued Dec. 2, 1980, which is incorporated herein by reference. Excessive levels of free amines may result in odor problems, and generally free amines provide poorer softening performance than the amine salts.

Preferred amine salts for use herein are those wherein the amine moiety is a $C_8$–$C_{30}$ alkyl or alkenyl dimethyl amine or a di-$C_8$–$C_{30}$ alkyl or alkenyl methyl amine, and the acid moiety is a $C_8$–$C_{30}$ alkyl or alkenyl monocarboxylic acid. The amine and the acid, respectively, used to form the amine salt will often be of mixed chain lengths rather than single chain lengths, since these materials are normally derived from natural fats and oils, or synthetic processed which produce a mixture of chain lengths. Also, it is often desirable to utilize mixtures of different chain lengths in order to modify the physical or performance characteristics of the softening composition.

Specific preferred amine salts for use in the present invention are oleyldimethylamine stearate, stearyidimethylamine stearate, stearyidimethylamine myristate, stearyldimethylamine oleate, stearyidimethylamine palmitate, distearylmethylamine palmitate, distearylmethylamine laurate, and mixtures thereof. A particularly preferred mixture is oleyidimethylamine stearate and distearylmethylamine myristate, in a ratio of 1:10 to 10:1, preferably about 1:1.

(2) Optional Nonionic Softener

An optional softening agent of the present invention is a nonionic fabric softener material. Typically, such nonionic fabric softener materials have an HLB of from about 2 to about 9, more typically from about 3 to about 7. In general, the materials selected should be relatively crystalline, higher melting, (e.g., >25° C).

The level of optional nonionic softener in the solid composition is typically from about 10% to about 50%, preferably from about 15% to about 40%.

Preferred nonionic softeners are fatty acid partial esters of polyhydric alcohols, or anhydrides thereof, wherein the alcohol, or anhydride, contains from about 2 to about 18, preferably from about 2 to about 8, carbon atoms, and each fatty acid moiety contains from about 8 to about 30, preferably from about 12 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan.

The fatty acid portion of the ester is normally derived from fatty acids having from about 8 to about 30, preferably from about 12 to about 22, carbon atoms. Typical examples of said fatty acids being lauric acid, myristic acid, palmitic acid, stearic acid, oleic acid, and behenic acid.

Highly preferred optional nonionic softening agents for use in the present invention are $C_{10}$–$C_{26}$ acyl sorbitan esters and polyglycerol monostearate. Sorbitan esters are esterified dehydration products of sorbitol. The preferred sorbitan ester comprises a member selected from the group consisting of $C_{10}$–$C_{26}$ acyl sorbitan monoesters and $C_{10}$–$C_{26}$ acyl sorbitan diesters and ethoxylates of said esters wherein one or more of the unesterified hydroxyl groups in said esters contain from 1 to about 6 oxyethylene units, and mixtures thereof. For the purpose of the present invention, sorbitan esters containing unsaturation (e.g., sorbitan monooleate) can be utilized.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide, fatty acid ester, and/or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society,* Vol. 45, October 1968.

Details, including formula, of the preferred sorbitan esters can be found in U.S. Pat. No. 4,128,484, incorporated hereinbefore by reference.

Certain derivatives of the preferred sorbitan esters herein, especially the "lower" ethoxylates thereof (i.e., mono-, di-, and tri-esters wherein one or more of the unesterified —OH groups contain one to about twenty oxyethylene moieties (Tweens®) are also useful in the composition of the present invention. Therefore, for purposes of the present invention, the term "sorbitan ester" includes such derivatives.

For the purposes of the present invention, it is preferred that a significant amount of di- and tri- sorbitan esters are present in the ester mixture. Ester mixtures having from 20–50% mono-ester, 25–50% di-ester and 10–35% of tri- and tetra-esters are preferred.

The material which is sold commercially as sorbitan mono-ester (e.g., monostearate) does in fact contain significant amounts of di- and tri-esters and a typical analysis of sorbitan monostearate indicates that it comprises about 27% mono-, 32% di- and 30% tri- and tetra-esters. Commercial sorbitan monostearate therefore is a preferred material.

Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid, ester, or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Glycerol and polyglycerol esters, especially glycerol, diglycerol, triglycerol, and polyglycerol mono- and/or di-esters, preferably mono-, are also preferred herein (e.g., polyglycerol monostearate with a trade name of Radiasurf 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated to form usable derivatives that are included within the term "glycerol esters."

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

(3) Optional Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink/Hardy/Trinh, issued Sep. 11, 1990, discloses specific preferred soil release agents comprising cationic functionalities, said patent being incorporated herein by reference.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

U.S. Pat. No. 4,976,879, Maldonado/Trinh/Gosselink, issued Dec. 11, 1990, discloses specific preferred soil release agents which can also provide improved antistat benefit, said patent being incorporated herein by reference.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

A more complete disclosure of these highly preferred soil release agents is contained in European Pat. Application 185,427, Gosselink, published Jun. 25, 1986, incorporated herein by reference.

(4) Optional Cyclodextrin/Perfume Complexes and Free Perfume

The products herein can also contain from about 0% to about 60%, preferably from about 0.5% to about 60%, more preferably from about 1% to about 50%, cyclodextrin/perfume inclusion complexes and/or free perfume, as disclosed in U.S. Pat. No. 5,139,687, Borcher et al., issued Aug. 18, 1992; and U.S. Pat. No. 5,234,610, Gardlik et al., to issue Aug. 10, 1993, which are incorporated herein by reference. Perfumes are highly desirable, can usually benefit from protection, and can be complexed with cyclodextrin. Fabric softening products typically contain perfume to provide an olfactory aesthetic benefit and/or to serve as a signal that the product is effective.

The optional perfume ingredients and compositions of this invention are the conventional ones known in the art. Selection of any perfume component, or amount of perfume, is based solely on aesthetic considerations. Suitable perfume compounds and compositions can be found in the art including U.S. Pat. No. 4,145,184, Brain and Cummins, issued Mar. 20, 1979; U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979, all of said patents being incorporated herein by reference. Many of the art recognized perfume compositions are relatively substantive to maximize their odor effect on substrates. However, it is a special advantage of perfume delivery via the perfume/cyclodextrin complexes that non-substantive perfumes are also effective. If a product contains both free and complexed perfume, the escaped perfume from the complex contributes to the overall perfume odor intensity, giving rise to a longer lasting perfume odor impression.

As disclosed in U.S. Pat. No. 5,234,610, Gardlik/Trinh/Banks/Benvegnu, issued Aug. 3, 1993, said patent being incorporated herein by reference, by adjusting the levels of free perfume and perfume/CD complex it is possible to provide a wide range of unique perfume profiles in terms of timing (release) and/or perfume identity (character). Solid, dryer-activated fabric conditioning compositions are a uniquely desirable way to apply the cyclodextrins, since they are applied at the very end of a fabric treatment regimen when the fabric is clean and when there are almost no additional treatments that can remove the cyclodextrin.

(5) Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.05% to about 0.1% for antioxidants and more preferably from about 0.01% to about 0.2% for reductive agents. These assure good odor stability under long term storage conditions for the compositions. Use of antioxidants and reductive agent stabilizers is especially critical for unscented or low scent products (no or low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox S-1; a mixture of BHT, BHA, propyl gallate, and citric acid available from Eastman Chemicals Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA.

Examples of reductive agents include sodium borohydride, hypophosphorous acid, and mixtures thereof.

(6) Other Optional Ingredients

The present invention can include other optional components (minor components) conventionally used in textile treatment compositions, for example, colorants, preservatives, optical brighteners, opacifiers, stabilizers such as guar gum and polyethylene glycol, anti-shrinkage agents, anti-wrinkle agents, fabric crisping agents, spotting agents, germicides, fungicides, anti-corrosion agents, anti-foam agents, and the like.

D. Substrate Articles

In preferred embodiments, the present invention encompasses articles of manufacture. Representative articles are those that are adapted to soften fabrics in an automatic laundry dryer, of the types disclosed in U.S. Pat. No. : 3,989,631 Marsan, issued Nov. 2, 1976; U.S. Pat. No. 4,055,248, Marsan, issued Oct. 25, 1977; U.S. Pat. No. 4,073,996, Bedenk et al., issued Feb. 14, 1978; U.S. Pat. No. 4,022,938, Zaki et al., issued May 10, 1977; U.S. Pat. No. 4,764,289, Trinh, issued Aug. 16, 1988; U.S. Pat. No. 4,808,086, Evans et al., issued Feb. 28,1989; U.S. Pat. No. 4,103,047, Zaki et al., issued July 25, 1978; U.S. Pat. No. 3,736,668, Dillarstone, issued June 5, 1973; U.S. Pat. No. 3,701,202, Compa et al., issued Oct. 31, 1972; U.S. Pat. No. 3,634,947, Furgal, issued Jan. 18, 1972; U.S. Pat. No. 3,633,538, Hoeflin, issued Jan. 11, 1972; and U.S. Pat. No. 3,435,537, Rumsey, issued Apr. 1, 1969; and U.S. Pat. No. 4,000,340, Murphy et al., issued Dec. 28, 1976, all of said patents being incorporated herein by reference.

In a preferred substrate article embodiment, the fabric treatment compositions are provided as an article of manufacture in combination with a dispensing means such as a flexible substrate which effectively releases the composition in an automatic laundry (clothes) dryer. Such dispensing means can be designed for single usage or for multiple uses. The dispensing means can also be a "carrier material" that releases the fabric softener composition and then is dispersed and/or exhausted from the dryer.

The dispensing means will normally carry an effective amount of fabric treatment composition. Such effective amount typically provides sufficient fabric conditioning/antistatic agent and/or anionic polymeric soil release agent for at least one treatment of a minimum load in an automatic laundry dryer. Amounts of fabric treatment composition for multiple uses, e.g., up to about 30, can be used. Typical amounts for a single article can vary from about 0.25 g to about 100 g, preferably from about 0.5 g to about 20 g, most preferably from about 1 g to about 10 g.

Highly preferred paper, woven or nonwoven "absorbent" substrates useful herein are fully disclosed in U.S. Pat. No. 3,686,025, Morton, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

Another article comprises a sponge material releasably enclosing enough fabric treatment composition to effectively impart fabric soil release, antistatic effect and/or softness benefits during several cycles of clothes. This multi-use article can be made by filling a hollow sponge with about 20 grams of the fabric treatment composition.

E. Usage

The substrate embodiment of this invention can be used for imparting the above-described fabric treatment composition to fabric to provide softening and/or antistatic effects to fabric in an automatic laundry dryer. Generally, the method of using the composition of the present invention comprises: commingling pieces of damp fabric by tumbling said fabric under heat in an automatic clothes dryer with an effective amount of the fabric treatment composition. At least the continuous phase of said composition has a melting point greater than about 35° C. and the composition is flowable at dryer operating temperature. This composition comprises from about 10% to about 99.99%, preferably from about 15% to about 90%, of the quaternary ammonium agent selected from the above-defined cationic fabric softeners and mixtures thereof, from about 0% to about 95%, preferably from about 20% to about 75%, more preferably from about 20% to about 60% of the above-defined co-softener.

The present invention relates to improved solid dryer-activated fabric softener compositions which are either (A) incorporated into articles of manufacture in which the compositions are, e.g., on a substrate, or are (B) in the form of particles (including, where appropriate, agglomerates, pellets, and tablets of said particles). Such compositions contain from about 30% to about 95% of normally solid, dryer-softenable material, typically fabric softening agent, containing an effective amount of unsaturation.

In the specification and examples herein, all percentages, ratios and parts are by weight unless otherwise specified and all numerical limits are normal approximations.

The following examples illustrate the esters and compositions of this invention, but are not intended to be limiting thereof.

EXAMPLES

Example 1

Di(9-decen-1-yl) p-t-bucinal acetal

9-Decen-1-ol in the amount of 48.55 g (0.311 mol), p-t-Bucinal in the amount of 21.25 g (0.104 mol), pyridinium p-toluenesulfonate in the amount of 1.31 g (5.20 mmol) and benzene in the amount of 200 mL are combined in a 500 mL single-necked round-bottomed flask fitted with a Dean-Stark trap, condenser, argon inlet, and heating mantel. The mixture is brought to reflux. After 18 h, the theoretical amount of water is collected in the Dean-Stark trap. After cooling, the reaction mixture is treated with 5 g of solid sodium carbonate for 2 h and filtered. The solvent is removed under reduced pressure followed by removal of unreacted starting materials via bulb-to-bulb distillation at 65–85° C. (0.2 mm Hg) yielding a yellow oil. The oil is purified by column chromatography (elution with 5% ethyl acetate dissolved in petroleum ether) to give a near colorless oil. Purity of the product is determined by thin layer chromatography and the structure confirmed by mass spectrometry, $^{1}H$ and $^{13}C$ NMR.

Example 2 p-t-Bucinal acetal blend made from a mixture of β-γ-hexenol, 9-decen-1-ol and phenoxanol p-t-Bucinal in the amount of 161.18 g (0.789 mol), β-γ-hexenol in the amount of 37.95 g (0.379 mol), 9-decen-1-ol in the amount of 187.88 g (1.202 mol), phenoxanol in the amount of 187.88 g (1.05 mol), pyridinium p-toluenesulfonate in the amount of 1.35 g (5.37 mmol) and benzene in the amount of 200 mL are combined in a flask fitted with a condenser, argon inlet and Dean-Stark trap. The mixture is heated to reflux for 48 h at which time the theoretical amount of water is collected. After cooling, the reaction mixture is treated with 2 g of solid sodium methoxide and 5 g solid sodium carbonate. The solvent is removed by rotary evaporation followed by removal of unreacted starting materials via bulb-to-bulb distillation at 80–90° C., 0.05 mm Hg to give an orange/brown mixture. The resulting mixture is taken up in an equal amount of dichloromethane and the resulting solution filtered through a celite plug. The filtrate is concentrated by rotary evaporation to yield a yellow oil. The oil is purified by column chromatography (elution with 5% ethyl acetate dissolved in petroleum ether) to give a near colorless oil. Purity of the product is determined by thin layer chromatography and GC analysis and the structure confirmed by mass spectrometry, $^{1}H$ and $^{13}C$ NMR.

Example 3

Triplal Acetal Blend Made from a Mixture of β-γ-hexenol, 9-decen-1-ol and phenoxanol Triplal in the amount of 100.00 g (0.724 mol), β-γ-hexenol in the amount of 34.84 g (0.348 mol), 9-decen-1-ol in the amount of 172.43 g (1.103 mol), phenoxanol in the amount of 172.43 g (0.967 mol), pyridinium p-toluenesulfonate in the amount of 1.30 g (5.17 mmol) and benzene in the amount of 200 mL are combined in a flask fitted with a condenser, argon inlet and Dean-Stark trap. The mixture is heated to reflux for 48 h at which time the theoretical amount of water is collected. After cooling, the reaction mixture is treated with 2 g of solid sodium methoxide and 5 g of solid sodium carbonate. The solvent is removed by rotary evaporation followed by removal of unreacted starting materials via bulb-to-bulb distillation at 80–90° C., 0.05 mm Hg to give a red/brown mixture. The resulting mixture is taken up in an equal amount of dichloromethane and the resulting solution filtered through a celite plug. The filtrate is concentrated by rotary evaporation to yield a yellow oil. The oil is purified by column chromatography (elution with 5% ethyl acetate dissolved in petroleum ether) to give a near colorless oil. Purity of the product is determined by thin layer chromatography and GC analysis and the structure confirmed by mass spectrometry, $^{1}H$ and $^{13}C$ NMR.

Example 4

Di(β-γ-hexenyl)p-t-bucinal acetal p-t-Bucinal in the amount of 44.97 g (0.220 mol), β-γ-hexenol in the amount of 48.48 g (0.484 mol), pyridinium p-toluenesulfonate in the amount of 0.65 g (2.59 mmol) and toluene in the amount of 200 mL are combined in a flask fitted with a condenser, argon inlet and Dean-Stark trap. The mixture is heated to reflux for 24 h at which time the theoretical amount of water is collected. After cooling, the reaction mixture is treated with 1 g of solid sodium methoxide and 3 g of solid sodium carbonate for 2 h and then filtered. The solvent is removed by rotary evaporation followed by removal of unreacted starting materials via bulb-to-bulb distillation at 80–90° C. (0.05 mm Hg) to give an orange/red oil. The oil is purified by column chromatography (elution with 5% ethyl acetate dissolved in petroleum ether) to give a near colorless oil. Purity of the product is determined by thin layer chromatography and GC analysis and the structure confirmed by mass spectrometry, $^{1}H$ and $^{13}C$ NMR.

Example 5

Di(β-citronellyl) Acetal Blend of p-t-bucinal, triplal, citral, a-hexylcinnamic aldehyde and decanal p-t-Bucinal in the amount of 4.5 g (0.0220 mol), triplal in the amount of 0.30 g (0.0022 mol), citral in the amount of 0.20 g (0.013 mol), a-hexylcinnamic aldehyde in the amount of 4.5 g (0.0208 mol), decanal in the amount of 0.50 g (0.0032 mol), b-citronellol in the amount of 28.50 g (0.173 mol), p-toluenesulfonic acid in the amount of 0.10 g (5.0 mmol) and toluene in the amount of 70 mL are combined in a flask fitted with a condenser, argon inlet and Dean-Stark trap. The mixture is heated to reflux for 6 h at which time the theoretical amount of water is collected. After cooling, the reaction mixture is treated with 2 g of solid sodium carbonate for 30 minutes and filtered. The solvent is removed by rotary evaporation followed by removal of unreacted starting materials via bulb-to-bulb distillation at 80–90° C., 0.05 mm Hg to give a yellow/red liquid. The liquid is purified by column chromatography (elution with 1% ethyl acetate dissolved in petroleum ether) to give oil. Purity of the product is determined by thin layer chromatography and GC analysis and the structure confirmed by $^{1}H$ and $^{13}C$ NMR.

Example 6

Didodecyl floralozone acetal

Floralozone in the amount of 10.00 g (0.053 mol), dodecanol in the amount of 21.32 g (0.116 mol), p-toluenesulfonic acid in the amount of 0.50 g (2.63 mmol) and toluene in the amount of 75 mL are combined in a flask fitted with a condenser, argon inlet and Dean-Stark trap. The mixture is heated to reflux for 24 h. After cooling, the reaction mixture is treated with 1 g of solid sodium methoxide and 1 g of solid sodium carbonate for 2 h and then filtered. The solvent is removed by rotary evaporation followed by removal of unreacted starting materials via bulb-to-bulb distillation at 80–90° C. (0.05 mm Hg) to give an orange/red oil. The oil is purified by column chromatography (elution with 5% ethyl acetate dissolved in petroleum ether). Purity of the product is determined by thin layer chromatography and GC analysis and the structure confirmed by $^{1}H$ and $^{13}C$ NMR.

Examples of Dryer Sheet Compositions Containing Acetals of Perfume Alcohols

| Formulation Example Ingredient | A Wt. % | B Wt. % | C Wt. % | D Wt. % | E Wt. % | F Wt. % | G Wt. % | H Wt. % |
|---|---|---|---|---|---|---|---|---|
| DEQA(1) | 44.23 | 39.16 | — | — | — | — | — | — |
| DEQA(2) | — | — | 51.81 | 21.81 | — | 34.74 | — | — |
| DEQA(3) | — | — | — | — | 28.32 | — | — | — |
| DEQA(4) | — | — | — | — | — | — | 31.33 | — |
| DTDMAMS (5) | — | — | — | — | — | — | — | 18.64 |
| Cosoftener(6) | 49.60 | 34.41 | 26.38 | 21.33 | 39.41 | 23.20 | 28.04 | |
| Glycosperse S-20(7) | — | — | 15.38 | 12.38 | — | 18.04 | — | — |
| Sorbitan Monooleate | — | — | — | — | 25.75 | — | — | — |
| Glycerol Monostearate | — | — | — | — | — | 18.04 | — | 18.87 |
| Clay | 4.02 | 4.02 | 3.16 | 3.16 | 4.12 | 4.64 | 4.52 | 3.91 |
| Perfume | 1.65 | 0.70 | 1.52 | 0.70 | 1.15 | — | 1.11 | — |
| Perfume/Cyclodextrin complex | — | — | — | — | — | — | 18.38 | — |
| Product of Example 1 (8) | — | 2.60 | — | — | — | — | 0.25 | — |
| Product of Example 2 (9) | 0.50 | — | — | — | — | — | — | 2.60 |
| Product of Example 3 (10) | — | — | 1.75 | — | — | 1.34 | — | — |
| Product of Example 4 (11) | — | — | — | 2.60 | — | — | — | — |
| Product of Example 5 (12) | — | — | — | — | 1.25 | — | — | — |
| Product of Example 6 (13) | — | — | — | — | — | — | 0.25 | — |
| Polyamine(14) | — | 2.10 | — | 4.10 | — | — | — | 5.20 |
| Stearic Acid | — | 55.78 | — | 33.92 | — | — | — | 22.74 |

(1) Di-(oleyloxyethyl) dimethyl ammonium methylsulfate
(2) Di-(soft-tallowyloxyethyl) hydroxyethyl methyl ammonium methylsulfate
(3) Di-(soft-tallowyloxyethyl) dimethyl ammonium methylsulfate
(4) Di-(soft-tallowyloxy) trimethyl ammoniopropane methylsulfate
(5) Ditallow dimethyl ammonium methylsulfate
(6) 1:2 Ratio of stearyl dimethyl ammine:triple-pressed stearic acid
(7) Polyethoxylated sorbitan monostearate, available from Lonza
(8) Di(9-decen-1-yl) p-t-bucinal acetal
(9) p-t-bucinal acetal blend made from a mixture of β-γ-hexenol, 9-decen-1-ol and phenoxanol
(10) Triplal acetal blend made from a mixture of β-γ-hexenol, 9-decen-1-ol and phenoxanol
(11) Di(β-γ-hexenyl)p-t-bucinal acetal
(12) Di(β-citronellyl) acetal blend of p-t-bucinal, citral, α-hexycinnamic aldehyde and decanal
(13) Didodecyl floralozone acetal
(14) Ethoxylated Poly(ethyleneimine)-MW 1800

Preparation of Coating Mix (Formula A)

A batch of approximately 200 g is prepared as follows: Approximately 99.2 g of co-softener and about 88.5 g DEQA(1) are melted separately at about 80° C. They are combined with high shear mixing in a vessel immersed in a hot water bath to maintain the temperature between 70–80° C. Calcium bentonite clay (8 g) is mixed in to achieve the desired viscosity. The Product of Example 2 (1.0 g) and perfume (3.3 g) are added to the formula and mixed until homogeneous.

Coating mixes for Formulas B–H are made in a like manner, using the materials indicated in the table above.

Preparation of Fabric Conditioning Sheets

The coating mixture is applied to pre-weighed substrate sheets of about 6.75 inches×12 inches (approximately 17 cm×30 cm) dimensions. the substrate sheets are comprised of about 4-denier spun bonded polyester. A small amount of the formula is placed on a heated metal plate with a spatula and then is spread evenly with a wire metal rod. A substrate sheet is placed on the metal plate to absorb the coating mixture. The sheet is then removed from the heated metal plate and allowed to cool to room temperature so that the coating mix can solidify. The sheet is weighed to determine the amount of coating mixture on the sheet. The target sheet weight is 3.5 g. If the weight is in excess of the target weight, the sheet is placed back on the heated metal plate to remelt the coating mixture and remove some of the excess. If the weight is under the target weight, the sheet is also placed on the heated metal plate and more coating mixture is added.

What is claimed is:

1. A dryer activated fabric softening composition comprising:

(A) from about 0.01% to about 15%, by weight of the composition, of pro-fragrant acetal, said acetal having the formula:

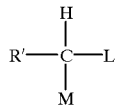

wherein R' and the H are derived from parent aldehyde having a chain length of $C_8$ or greater and wherein L and M are alkoxy moieties derived from parent alcohols having a chain length of $C_6$ or greater, and wherein at least one of the parent aldehyde, or alcohols of said pro-fragrant acetal is a fragrance compound;

(B) from about 10% to about 99.99% of fabric softening compound.

2. The composition of claim 1 wherein at least one parent alcohol of the pro-fragrant acetal is selected from the group consisting of amyl alcohol; undecylenic alcohol; osyrol; sandalore; dihydro carveol; dihydro linalool; dihydromyrcenol; dihydro terpineol; dimetol; mycenol; alpha-terpineol; tetrahydro linalool; tetrahydro mugol; tetrahydro myrcenol; amyl cinnamic alcohol; decenol; trans-2-hexenol; patchomint; prenol; cuminyl alcohol; para-tolyl alcohol; phenylethyl carbinol; ethyl vanillin; isoamyl salicylate; para-hydroxyphenyl butanone; phenethyl salicylate; ethyl linalool; linalool; dihydromyrcenol; nerolidol; beta gamma hexenol; decyl alcohol; dihydro floralol; hawthanol; heptyl alcohol; isoamyl alcohol; isocyclo geraniol; isononyl geraniol; mayol; methyl lavendar ketone; octyl alcohol; phenyl propyl alcohol; rhodinol 70; rosalva; camelkol dh; cyclohexyl propyl alcohol; isobutyl benzyl alcohol; lavinol; phenyl ethyl methyl carbinol; propyl benzyl carbinol; iso pulegol; menthol; patchone; rootanol; roselea; trans decahydro beta naphthol; verdol; cinnamic alcohol; farnesol; geraniol; nerol; anisic alcohol; benzyl alcohol; undecavertol; eugenol; isoeugenol; and vanillin.

3. The composition of claim 1 wherein the parent aldehyde of the pro-fragrant acetal is selected from the group consisting of adoxal; chrysanthal; cyclamal; cymal; trans-4-decanal; ethyl vanillin; helional; hydrotrope aldehyde; hydroxycitronellal; isocyclocitral; melonal; methyl nonyl aldehyde; methyl octyl aldehyde; octyl aldehyde; phenyl propanal; citronellal; dodecyl aldehyde; hexylcinnamic aldehyde; myrac aldehyde; vanillin; anisic aldehyde; citral; decyl aldehyde; floralozone; p.t.-bucinal; and triplal.

4. The composition of claim 3 wherein at least one parent alcohol of the pro-fragrant acetal is selected from the group consisting of amyl alcohol; undecylenic alcohol; osyrol; sandalore; dihydro carveol; dihydro linalool; dihydromyrcenol; dihydro terpineol; dimetol; mycenol; alpha-terpineol; tetrahydro linalool; tetrahydro mugol; tetrahydro myrcenol; amyl cinnamic alcohol; decenol; trans-2-hexenol; patchomint; prenol; cuminyl alcohol; para-tolyl alcohol; phenylethyl carbinol; ethyl vanillin; isoamyl salicylate; para-hydroxyphenyl butanone; phenethyl salicylate; ethyl linalool; linalool; dihydromyrcenol; nerolidol; beta gamma hexenol; decyl alcohol; dihydro floralol; hawthanol; heptyl alcohol; isoamyl alcohol; isocyclo geraniol; isononyl geraniol; mayol; methyl lavendar ketone; octyl alcohol; phenyl propyl alcohol; rhodinol 70; rosalva; camelkol dh; cyclohexyl propyl alcohol; isobutyl benzyl alcohol; lavinol; phenyl ethyl methyl carbinol; propyl benzyl carbinol; iso pulegol; menthol; patchone; rootanol; roselea; trans decahydro beta naphthol; verdol; cinnamic alcohol; famesol; geraniol; nerol; anisic alcohol; benzyl alcohol; undecavertol; eugenol; isoeugenol; and vanillin.

5. The composition of claim 4 wherein said pro-fragrant acetal comprises one or more acetals selected from the group consisting of: di(9-decen-1-yl) p-t-bucinal acetal; p-t-bucinal acetal blend made from a mixture of β-γ-hexenol, 9-decen-1-ol and phenoxanol; triplal acetal blend made from a mixture of β-γ-hexenol, 9-decen-1-ol and phenoxanol; di(β-γ-hexenyl) p-t-bucinal acetal; di(β-citronellyl) acetal blend of p-t-bucinal, citral, α-hexycinnamic aldehyde and decanal; and didodecyl floralozone acetal.

6. A dryer-activated fabric conditioning composition comprising:

(A) from about 0.01% to about 15%, by weight of the composition, of pro-fragrant acetal, said acetal having the formula:

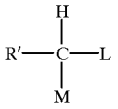

wherein R' and the H are derived from parent aldehyde having a chain length of $C_8$ or greater and wherein L and M are alkoxy moieties derived from parent alcohols having a chain length of $C_6$ or greater, and wherein at least one parent alcohol of the pro-fragrant acetal is selected from the group consisting of fragrant $C_6$ to $C_{20}$ saturated or unsaturated, linear, cyclic or branched, substituted or unsubstituted alcohols, and alkoxylates of said alcohols;

(B) from about 10% to about 95% of quaternary ammonium compound selected from the group consisting of the compounds of:

$$(R^1)_{4-p}—N^+—((CH_2)_v—Y—R^2)_pX^- \qquad \text{Formula I}$$

wherein each Y is —O—(O)C—, or —C(O)—O—;

p is 1 to 3;

each v is an integer from 1 to 4;

each $R^1$ substituent is a short chain $C_1$–$C_6$ alkyl group;

each $R^2$ is $C_8$–$C_{30}$ hydrocarbyl or substituted hydrocarbyl substituent; and the counterion, $X^-$, can be any softener-compatible anion; and Formula I

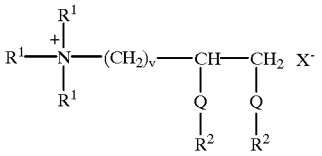

wherein each Q is —O—C(O)— or —C(O)—O— each $R^1$ is $C_1$–$C_4$ alkyl or hydroxy alkyl group;

each $R^2$, v, and $X^-$ are defined hereinbefore for Formula I;

Formula III

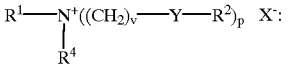

wherein $R^4$ is a short chain $C_1$–$C_4$ alcohol;

p is 2;

$R^1$,$R^2$, v, Y', and $X^-$ are defined hereinbefore for Formula I;

$$(R^1)_{4-p}—N^+—((CH_2)_v—Y''—R^2)_pX^- \qquad \text{Formula IV:}$$

wherein $R^1$, $R^2$, p, v, and $X^-$ are defined hereinbefore for Formula I; and $$Y'' = -NH-\overset{O}{\overset{\|}{C}}; \quad -\overset{O}{\overset{\|}{C}}-NH; \quad O-\overset{O}{\overset{\|}{C}}-; \quad -\overset{O}{\overset{\|}{C}}-O;$$

and mixtures thereof, wherein at least one Y" group is $$-NH-\overset{O}{\overset{\|}{C}} \text{ or } -\overset{O}{\overset{\|}{C}}-NH-;$$

and mixtures thereof, (C)(1) optionally, from 0% to about 95% of co-softener comprising a carboxylic acid salt of a tertiary amine, tertiary amine ester, or mixtures thereof;

(C)(2) optionally, from 0% to about 50% of nonionic softener;

wherein the Iodine Value of the total number of fatty acyl groups present in (B), (C)(1), and (C)(2) is from about 3 to about 60.

7. The composition of claim 6 wherein at least one parent alcohol of the pro-fragrant acetal is selected from the group consisting of amyl alcohol; undecylenic alcohol; osyrol; sandalore; dihydro carveol; dihydro linalool; dihydromyrcenol; dihydro terpineol; dimetol; mycenol; alpha-terpineol; tetrahydro linalool; tetrahydro mugol; tetrahydro myrcenol; amyl cinnamic alcohol; decenol; trans-2-hexenol; patchomint; prenol; cuminyl alcohol; para-tolyl alcohol; phenylethyl carbinol; ethyl vanillin; isoamyl salicylate; para-hydroxyphenyl butanone; phenethyl salicylate; ethyl linalool; linalool; dihydromyrcenol; nerolidol; beta gamma hexenol; decyl alcohol; dihydro floralol; hawthanol; heptyl alcohol; isoamyl alcohol; isocyclo geraniol; isononyl geraniol; mayol; methyl lavendar ketone; octyl alcohol; phenyl propyl alcohol; rhodinol 70; rosalva; camelkol dh; cyclohexyl propyl alcohol; isobutyl benzyl alcohol; lavinol; phenyl ethyl methyl carbinol; propyl benzyl carbinol; iso pulegol; menthol; patchone; rootanol; roselea; trans decahydro beta naphthol; verdol; cinnamic alcohol; farnesol; geraniol; nerol; anisic alcohol; benzyl alcohol; undecavertol; eugenol; isoeugenol; and vanillin.

8. The composition of claim 7 wherein the parent aldehyde of the pro-fragrant acetal is selected from the group consisting of adoxal; chrysanthal; cyclamal; cymal; trans-4-decanal; ethyl vanillin; helional; hydrotrope aldehyde; hydroxycitronellal; isocyclocitral; melonal; methyl nonyl aldehyde; methyl octyl aldehyde; octyl aldehyde; phenyl propanal; citronellal; dodecyl aldehyde; hexylcinnamic aldehyde; myrac aldehyde; vanillin; anisic aldehyde; citral; decyl aldehyde; floralozone; p.t.-bucinal; and triplal.

9. The composition of claim 8 wherein said pro-fragrant acetal comprises one or more acetals selected from the group consisting of: di(9-decen-1-yl)p-t-bucinal acetal; p-t-bucinal acetal blend made from a mixture of β-γ-hexenol, 9-decen-1-ol and phenoxanol; triplal acetal blend made from a mixture of β-γ-hexenol, 9-decen-1-ol and phenoxanol; di(β-γ-hexenyl) p-t-bucinal acetal; di(β-citronellyl) acetal blend of p-t-bucinal, citral, α-hexycinnamic aldehyde and decanal; and didodecyl floralozone acetal.

10. The composition of claim 9 wherein the Formula I compound is dimethyl bis(tallowyl oxy ethyl) ammonium methyl sulfate, derived from hardened tallow.

11. The composition of claim 9 wherein the composition comprises from about 15% to about 90% of Formula I compound and the Iodine Value is from about 8 to about 50.

12. The composition of claim 11 wherein the Formula I compound comprises dimethyl bis(acyl oxy ethyl) ammonium methyl sulfate derivatives of $C_8$–$C_{30}$ fatty acids, and mixtures thereof.

13. The composition of claim 12 wherein the Formula I compound is selected from the group consisting of dimethyl bis(tallowyl oxy ethyl) ammonium methyl sulfate; dimethyl bis(oleyl oxy ethyl) ammonium methyl sulfate; dimethyl bis(cocoyl oxy ethyl) ammonium methyl sulfate, and mixtures thereof.

14. The composition of claim 13 wherein the carboxylic acid salt forming anion moiety of the co-softener is selected from the group consisting of lauric, myristic, palmitic, stearic, oleic and mixtures thereof.

15. The composition of claim 14 wherein the amine salt is selected from the group consisting of oleyldimethylamine stearate, dioleylmethylamine stearate, linoleyldimethylamine stearate, dilinoleylmethylamine stearate, stearyidimethylamine stearate, distearylmethylamine myristate, stearyldimethylamine palmitate, distearylmethylamine palmitate, distearylmethylamine myristate, distearylmethylamine palmitate, distearylmethylamine laurate, dioleyldistearylmethylamine oleate, distearylmethylamine oleate, and mixtures thereof.

16. The composition of claim 15 wherein the composition additionally comprises:

(C)(3) from 0% to about 10% of soil release polymer;

(C)(4) from 0% to about 60% of cyclodextrin/perfume inclusion complexes and/or free perfume; and (C)(5) from 0% to about 2% of stabilizer selected from the group consisting of ascorbic acid, ascorbic palmitate, propyl gallate, citric acid, butylated hydroxytoluene, tertiary butylhydroquinone, natural tocopherois, butylated hydroxyanisole and mixtures thereof.

17. A dryer activated fabric softening composition comprising:

(A) from about 0.01% to about 15%, by weight of the composition, of pro-fragrant acetal, wherein said pro-fragrant acetal comprises one or more acetals selected from the group consisting of: di(9-decen-1-yl) p-t-bucinal acetal; p-t-bucinal acetal blend made from a mixture of β-γ-hexenol, 9-decen-1-ol and phenoxanol; triplal acetal blend made from a mixture of β-γ-hexenol, 9-decen-1-ol and phenoxanol; di(β-γ-hexenyl) p-t-bucinal acetal; di(β-citronellyl) acetal blend of p-t-bucinal, citral, α-hexycinnamic aldehyde and decanal; and didodecyl floralozone acetal;

(B) from about 30% to about 85% of quaternary ammonium compound selected from the group consisting of dimethyl bis(tallowyl oxy ethyl) ammonium methyl sulfate, dimethyl bis(oleyl oxy ethyl) ammonium methyl sulfate, dimethyl bis(cocoyl oxy ethyl) ammonium methyl sulfate, and mixtures thereof;

(C)(1) from about 20% to about 75% of co-softener selected from the group consisting of oleyidimethylamine stearate, distearylmethylamine myristate, and mixtures thereof; and (C)(2) from about 15% to about 40% of nonionic softener selected from the group consisting of $C_{10}$–$C_{26}$ acyl sorbitan monoester, diester, and mixtures thereof;

wherein the composition has a thermal softening point of from about 35° C. to about 100° C.

18. The composition of claim 17 wherein (C)(2) is selected from the group consisting of sorbitan monooleate, sorbitan monostearate, and mixtures thereof.

19. The composition of claim 18 wherein the composition additionally comprises:

(C)(3) from 0% to about 10% of a soil release polymer;

(C)(4) from 0% to about 60% of cyclodextrin/perfume inclusion complexes and/or free perfume; and (C)(5) from 0% to about 2% of a stabilizer selected from the group consisting of ascorbic acid, ascorbic palmitate, propyl gallate, citric acid, butylated hydroxytoluene, tertiary butylhydroquinone, natural tocopherols, butylated hydroxyanisole and mixtures thereof.

20. An article of manufacture comprising a flexible substrate containing from about 0.5 g to about 20 g of a dryer activated fabric softening composition comprising:

(A) from about 0.01% to about 15%, by weight of the composition, of pro-fragrant acetal, said acetal having the formula:

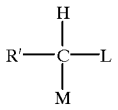

wherein R' and the H are derived from parent aldehyde having a chain length of $C_8$ or greater and wherein L and M are alkoxy moieties derived from parent alcohols having a chain length of $C_6$ or greater, and wherein at least one of the parent aldehyde, or alcohols of said pro-fragrant acetal is a fragrance compound;

(B) from about 10% to about 99.99% of fabric softening compound;

(C)(1) optionally, from 0% to about 95% of co-softener comprising a carboxylic acid salt of a tertiary amine, tertiary amine ester, or mixtures thereof;

(C)(2) optionally, from 0% to about 50% of nonionic softener;

(C)(3) optionally, from 0% to about 10% of a soil release polymer;

(C)(4) optionally, from 0% to about 60% of cyclodextrin/perfume inclusion complexes and/or free perfume; and (C)(5) optionally, from 0% to about 2% of a stabilizer selected from the group consisting of ascorbic acid, ascorbic palmitate, propyl gallate, citric acid, butylated hydroxytoluene, tertiary butylhydroquinone, natural tocopherols, butylated hydroxyanisole and mixtures thereof.

21. The process of using the article of claim 20 in an automatic laundry dryer to condition fabrics.

* * * * *